US005452268A

United States Patent [19]

Bernstein

[11] Patent Number: 5,452,268

[45] Date of Patent: Sep. 19, 1995

[54] ACOUSTIC TRANSDUCER WITH IMPROVED LOW FREQUENCY RESPONSE

[75] Inventor: Jonathan J. Bernstein, Medfield, Mass.

[73] Assignee: The Charles Stark Draper Laboratory, Inc., Cambridge, Mass.

[21] Appl. No.: 289,689

[22] Filed: Aug. 12, 1994

[51] Int. Cl.[6] ..... H04R 19/04

[52] U.S. Cl. ..... 367/181; 381/174; 381/191

[58] Field of Search ..... 367/181; 381/174, 191

[56] References Cited

U.S. PATENT DOCUMENTS

| | | | |
|---|---|---|---|
| 4,776,019 | 10/1988 | Miyatake | 381/174 |
| 4,922,471 | 5/1990 | Kuehnel | 367/181 |
| 5,146,435 | 9/1992 | Bernstein | 367/181 |
| 5,255,246 | 10/1993 | van Halteren | 367/181 |
| 5,303,210 | 4/1994 | Bernstein | 367/181 |

*Primary Examiner*—Charles T. Jordan
*Assistant Examiner*—Theresa M. Wesson
*Attorney, Agent, or Firm*—Iandiorio & Teska

[57] ABSTRACT

An acoustic transducer includes a perforated member; a movable diaphragm spaced from the perforated member; spring means interconnecting the diaphragm and the perforated member for movably supporting the diaphragm relative to the perforated member; a pressure equalization slot for controlling the flow of fluid through the diaphragm, the slot equalizing the pressure on opposite sides of the diaphragm for defining the low frequency response; and means for applying an electric field across the perforated member and the diaphragm for producing an output signal representative of the variation in capacitance induced by the variation of the space between the perforated member and the diaphragm in response to an incident acoustic signal.

20 Claims, 3 Drawing Sheets

ACOUSTIC TRANSDUCER WITH IMPROVED LOW FREQUENCY RESPONSE

FIELD OF INVENTION

This invention relates to an improved acoustic transducer, and more particularly to such a transducer which is small, integrated circuit compatible, and operates at low voltage with good low frequency response and sensitivity.

BACKGROUND OF INVENTION

In many applications capacitive acoustic transducers, such as condenser microphones, used in heating aids, are required to be quite small. As the transducers shrink to smaller and smaller volume the cavity compliance decreases proportionally. Cavity compliance is defined as the cavity volume divided by the bulk modulus of the fluid in the cavity: it is an indication of the ability of the cavity to absorb extra fluid when subject to an increase in pressure. The decrease in cavity compliance causes the 3 dB roll-off point or low frequency corner to shift upwardly in frequency, thereby dramatically reducing the low-frequency response of the transducer. This severely constrains the performance of such transducers when they must be made small, and conversely limits the size reduction when good low-frequency response is required such as in hearing aids, where the corner frequency may be 200 Hz, or in microphones for telephone and communication equipment, which may require frequency corners as low as 20 Hz. One attempt to address this problem uses sophisticated electronic circuitry which adds substantially to the cost and complexity and detracts from reliability. Conventional acoustic transducers have used a stretched polymer diaphragm which is metallized on one side. A hole is punched through the diaphragm to allow the pressure to balance on opposite sides of the diaphragm. However, in more recent developments the equalization hole was replaced by a slot which served the additional function of separating most of the diaphragm from the support layer leaving only limited interconnecting sections which acted as springs. See U.S. Pat. No. 5,146,435. This enabled the diaphragm, made of a stiffer material such as gold, nickel, copper, silicon, iron, polycrystalline silicon, silicon dioxide, silicon nitride, silicon carbide, titanium, chromium, platinum, palladium, aluminum, or their alloys to behave flexibly and facilitated the fabrication of the device from a single, even monolithic, structure made by micromachining photolithographic techniques compatible with integrated circuit manufacturing. With this additional function placed on the slot it appeared that the rather long length of the slot, coupled with its width, made an area which necessarily resulted in a much higher low frequency corner or 3 dB roll-off point, and that in such integrated circuit fabrications good low-frequency response was simply unavailable using typical micromachined size slots.

SUMMARY OF INVENTION

It is therefore an object of this invention to provide an improved acoustic transducer.

It is a further object of this invention to provide such an improved acoustic transducer which is simple, low cost and reliable.

It is a further object of this invention to provide such an improved acoustic transducer which can be made by micromachining photolithographic techniques compatible with integrated circuit fabrication.

It is a further object of this invention to provide such an improved acoustic transducer in which the number and shapes of the springs can be made to obtain any desired diaphragm compliance.

It is a further object of this invention to provide such an improved acoustic transducer which simply and effectively controls the low-frequency corner or 3 dB roll-off point.

It is a further object of this invention to provide such an improved acoustic transducer which is small and compact yet has good low-frequency response.

It is a further object of this invention to provide such an improved acoustic transducer which has good sensitivity even with low applied voltages.

The invention results from the realization that a truly simple and reliable acoustic transducer with good low frequency response and suitably flexible diaphragm made of relatively stiff material could be achieved by using a slot to substantially separate the diaphragm from its support structure except for some spring support and to simultaneously serve as the equalization passage between fluid on opposing sides of the diaphragm by employing a slot which is as long as approximately the perimeter of the diaphragm but only 0.1 to 10$\mu$ in width.

This invention features an acoustic transducer including a perforated member and a movable diaphragm spaced from the perforated member. There are spring means interconnecting the diaphragm and the perforated member for movably supporting the diaphragm relative to the perforated member. A pressure equalization slot controls the flow of fluid through the diaphragm. The slot equalizes the pressure on opposite sides of the diaphragm and has a width of between 0.1 and 10 microns for defining the low frequency response. There are means for applying an electric field across the perforated member and the diaphragm for producing an output signal representative of the variation in capacitance induced by the variation of the space between the perforated member and the diaphragm in response to an incident acoustic signal.

In a preferred embodiment a substantial portion of the slot may be covered by the perforated member and the slot and the perforations are unaligned to deflect and lengthen the path of the fluid flow through the slots and the perforations. The slot may be disposed generally at the perimeter of the diaphragm and it may be approximately the length of the perimeter of the diaphragm. The slot may include a plurality of sections. The slot may be formed at least partially between the conductive diaphragm and an insulator layer. The slot may be formed at least partially between portions of the conductive diaphragm. The diaphragm slot and spring means may be made from a silicon wafer using micromachining photolithographic techniques. The diaphragm and perforated member may be made from material from the group consisting of gold, nickel, copper, iron, silicon, polycrystalline silicon, silicon dioxide, silicon nitride, silicon carbide, titanium, chromium, platinum, palladium, aluminum, and their alloys.

This invention also features an acoustic transducer including a perforated member, a movable diaphragm spaced from the perforated member, and spring means interconnecting the diaphragm and the perforated member for movably supporting the diaphragm relative to the perforated member. A pressure equalization slot controls the flow of fluids through the diaphragm. The slot equalizes the pressure on opposite sides of the diaphragm for defining the low frequency response. A substantial portion of the slot is covered by the perforated member and the slot perforations are unaligned to deflect and lengthen the path of the fluid flow from the slot to the perforations. There are means for applying an electric field across the perforated member and the diaphragm for producing an output signal representative of the variation in capacitance induced by the variation of the space between the perforated member and the diaphragm in response to an incident acoustic signal.

In a preferred embodiment the slot may have a width of between 0.1 and 10 microns. The slot may be disposed generally at the perimeter of the diaphragm and the slot may be approximately the length of the perimeter of the diaphragm. The slot may include a plurality of sections. The diaphragm may be formed integrally with an insulator layer and the slot may be formed at least partially between the conductive diaphragm and the insulator layer. The slot may be formed at least partially between portions of the conductive diaphragm. The diaphragm slot and spring means may be made from a silicon wafer using micromachining photolithographic techniques. The diaphragm and perforated member may be made from material from the group consisting of gold, nickel, copper, silicon, polycrystalline silicon, silicon dioxide, silicon nitride, iron, silicon carbide, titanium, chromium, platinum, palladium, aluminum, and their alloys.

DISCLOSURE OF PREFERRED EMBODIMENT

Other objects, features and advantages will occur to those skilled in the art from the following description of a preferred embodiment and the accompanying drawings, in which.

Figure 1:
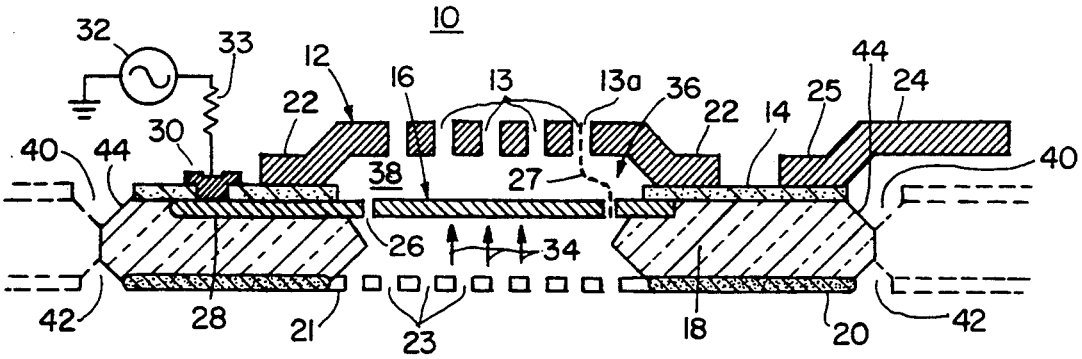
FIG. 1 is a schematic side elevational cross-sectional view taken along line 1—1 of FIG. 2 of an acoustic transducer according to this invention.
Figure 1A:
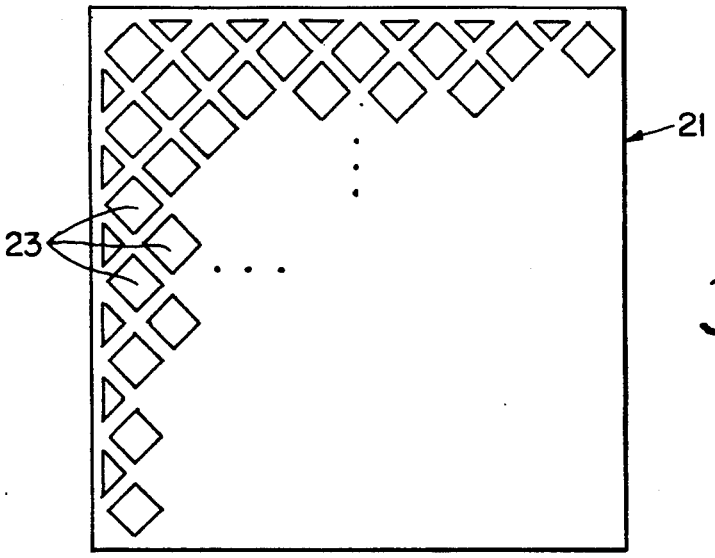
FIG. 1A is a bottom plan view of the filter of FIG. 1.

There is shown in FIG. 1 an acoustic transducer 10 according to this invention which includes a perforated plate or member, electrode 12, having perforations 13 and being mounted to insulating layer 14. Movable plate or diaphragm 16 is mounted to substrate 18. Insulating layer 14 may be made of silicon oxide or silicon nitride. Substrate 18 may be silicon. The layer 20 on the bottom of substrate 18 is an etch stop layer, typically a P+ diffusion layer or silicon oxide or nitride. Perforated member 12 is a conductive electrode mounted on insulating layer 14 by means of footings 22. External connections are made through beam leads 24 attached to insulator layer 14 by means of anchors 25. Diaphragm 16 includes a pressure equalization slot 26 and is connected via conductor 28 to contact 30. Fluid entering slot 26 must follow a tortuous path 27 which bends or deflects and is lengthened in order to enter a perforation 13*a*. This is done intentionally to further increase the resistance seen by fluid flowing through slot 26 in order to enhance the low frequency performance of the transducer. An electric field is applied across perforated bridge electrode member 12 and diaphragm 16 by an a.c. or d.c. voltage source 32 which is connected through a series resistor 33 to contact 30. Perforated bridge electrode 12 is connected to readout circuitry (shown in FIG. 3 but not in FIG. 1 ). A dust filter 21 may be used to keep contaminant particles from reaching the transducer. Filter 21 may contain diamond shaped holes 23, FIG. 1A, whose overlap allows etching during fabrication to proceed essentially unimpeded.

In operation, when acoustic wave energy, arrows 34, is incident on diaphragm 16, it is urged closer to perforated member 12. This changes the overall capacitance between diaphragm 16 and member 12 in the electric field produced by voltage generator 32. The change in capacitance provides a variation or modulation of the voltage provided by voltage generator 32 and this can be detected as a representation of the incident acoustic wave energy. The space 36 between perforated bridge electrode member 12 and diaphragm 16 is filled with a dielectric fluid 38. Since the capacitance of the device is proportional to the dielectric constant of the fluid 38 in space 36, the higher the dielectric constant the better will be the signal obtained. If the device is operated as a microphone the dielectric fluid will typically be air. If it is a hydrophone, for example, a nonconductive fluid would be used. If the specific gravity of the fluid is matched to that of the movable plate then errors due to motion of the plate responsive to acceleration forces will be reduced.

Figure 2:
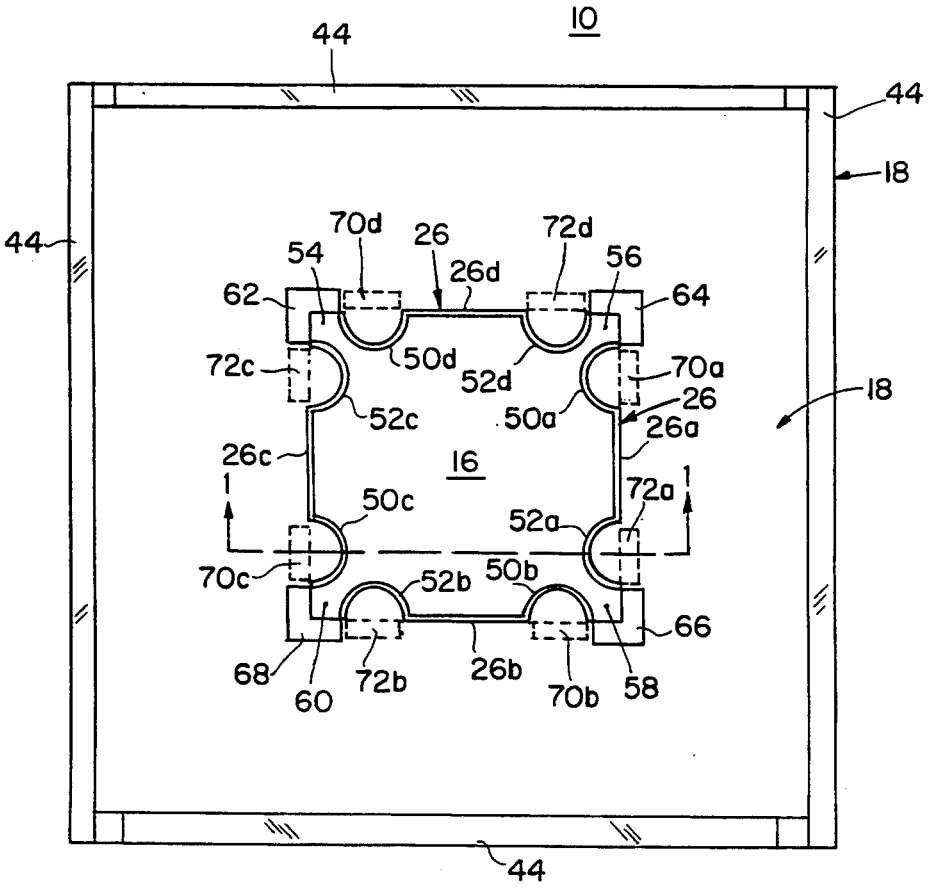
FIG. 2 is a top plan view of the acoustic transducer of FIG. 1 with the perforated bridge electrode, beam leads and insulating layer removed.

In a preferred construction the substrate 18 and diaphragm 16 and springs 54, 56, 58 and 60, FIG. 2, are all made of silicon. The dielectric fluid, alternatively to being air, may be freon, oil, or any other insulating fluid. Typically the transducer is constructed by micromachining photolithographic processes. The silicon areas to be protected during etching are doped with boron. An etchant such as ethylene diamine pyrocatechol is used. Pressure equalizing passage, slot 26, permits any changes in pressure in the medium in which the transducer is immersed, e.g., air or water, to equalize on both sides of the diaphragm 16.

Upper and lower V grooves 40, 42 are etched in substrate 18 during the fabrication process in order to allow easy separation of individual segments when that is desirable. These V grooves expose chamfered edges 44 which can be seen more clearly in FIG. 2, where the full course of slot 26 can be seen as including four sections 26*a, b, c, d*. Each section 26*a–d* of slot 26 takes on a curved portion 50*a*, 52*a*, 50*b*, 52*b*, 50*c*, 52*c*, and 50*d*, 52*d*, which define four springs 54, 56, 58 and 60. Springs 54–60 are attached to substrate 18 by corner anchors 62, 64, 66 and 68, respectively. The remainder of diaphragm 16 is made independent from substrate 18 by virtue of slots 26*a–d*. Thus slot 26 functions as a pressure equalization passage and as a means to separate the diaphragm 16 from substrate 18 and create springs 54–60. In this way, even though diaphragm 16 may be made of stiff material such as gold, nickel, copper, silicon, polycrystalline silicon, silicon dioxide, silicon nitride, silicon carbide, titanium, iron, chromium, platinum, palladium or aluminum, and alloys thereof, the needed flexibility can still be obtained and closely controlled by the separation of diaphragm 16 from substrate 18 and the shaping and sizing of springs 54–60 through the arrangement of slot 26. Bridge electrode member 12 may be made of the same materials.

The corner anchors 62–68 and the diaphragm 16 may be P+ boron doped areas, while the surrounding portion of substrate 18 is an N- type region. The areas 70*a*, 72*a*, 70*b*, 72*b*, 70*c*, 72*c*, 70*d*, and 72*d* associated with each of the curved portions 50*a*, 52*a*–50*d*, 52*d* are also P+ boron doped regions. The PN junction thus created isolates the two regions electrically.

Figure 3:
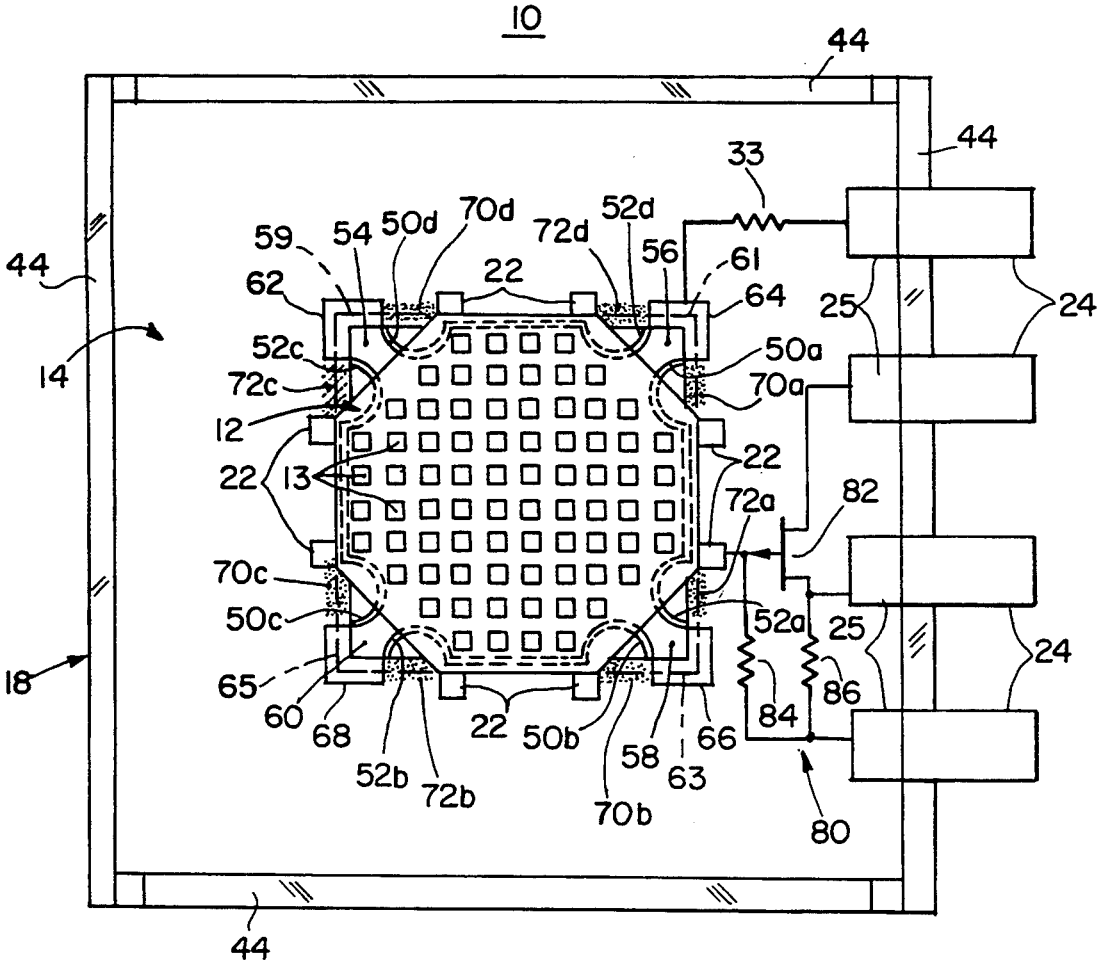
FIG. 3 is a top plan view similar to FIG. 2 with the beam leads, perforated bridge electrode and attendant circuitry present.

The extent to which slot 26 is unaligned with perforations 13 can be seen more clearly in FIG. 3, where no portion of slots 26*a–d* covered by bridge electrode member 12 are aligned with any of the perforations 13. It is only the small portions of the curved sections 50*a*, 52*a*–50*d*, 52*d* that are not covered by bridge electrode 12 which avoid a torturous path. The bridge electrode 12 and slots 50*a–d*, 52*a–d*, could be arranged so that no portion of the slot is uncovered by the bridge electrode. For example, in FIG. 3 the corners of bridge electrode 12 could be extended as shown in phantom at 59, 61, 63 and 65 to completely cover slots 50*a–d*, 52*a–d*, to get even lower frequency roll off. Bridge electrode 12 is fastened to insulating layer 14 by bridge electrode footings 22. Electrical connection to diaphragm 16 is made through resistor 33 via corner anchor 64 and the anchor 25 of one of the beam leads 24. The connection to bridge electrode 12 is made through the anchors 25 of the other three beam electrodes 24 which actually interconnect through a source follower circuit 80 which includes FET transistor 82 and biasing resistors 84 and 86.

Figure 4:
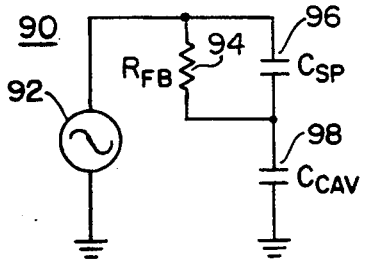
FIG. 4 is an equivalent circuit model of the acoustic transducer of FIGS. 1–3.

The problem of making an acoustic transducer in a small package with a good low frequency response can better be understood with reference to an equivalent circuit model 90, FIG. 4, of the acoustic transducer where the incident pressure wave is represented by source 92. The resistance of slot 26 is represented by resistor $R_{FB}$94; the compliance, $C_{SP}$, of the springs is represented by capacitor 96; and the compliance, $C_{CAV}$, of the cavity is represented by capacitor 98. The cavity compliance can be expressed as:

$$C_{CAV} = \frac{V_{CAV}}{\rho c^2} \tag{1}$$

The spring compliance can be expressed in terms of the diaphragm area S and diaphragm linear spring constant $k_{sp}$, as:

$$C_{sp} = \frac{S^2}{k_{sp}} \tag{2}$$

Preferably the cavity compliance $C_{CAV}$ is three or more times greater than the spring compliance $C_{sp}$ so that the cavity volume will have a small effect on the sensitivity and resonant frequency. From equations (1) and (2), it is apparent that the minimum package volume $V_{CAV}$ which may be calculated from the air bulk modulus ($\rho c^2$), the area of diaphragm 16, S($m^2$) and the linear spring constant $k_{sp}$(N/m) can be expressed as:

$$V_{CAV} \geqq \frac{3\rho c^2 S^2}{k_{sp}} \tag{3}$$

From equation (3) it can be seen that the necessary cavity volume rises vary rapidly with diaphragm diameter ($d^4$), assuming a constant spring constant. Thus if system volume is a constraint then Equation (3) may cause a constraint on the size of the diaphragm. The acoustic low frequency limit, that is, the low frequency corner or 3 dB roll-off point of the transducer, as shown in the equivalent circuit of FIG. 4, is set by the RC time constant of the pressure equalization slot 26 and the compliances of the cavity volume and diaphragm springs $C_{CAV}$, $C_{SP}$:

$$f_L = \frac{1}{2\pi R_{FB}(C_{AV} + C_{SP})} \tag{4}$$

Table I shows four design cases A–D for various cavity volumes, resonant frequencies, and diaphragm diameters.

TABLE 1

Microphone design cases used for slot-width simulation.

| Case | Cavity Volume ($mm^3$) | Resonant Frequency (Hz) | Diaphragm Diameter (mm) |
|---|---|---|---|
| A | 27 | 8 kHz | 1 |
| B | 8 | 8 kHz | 1 |
| C | 27 | 8 kHz | 1.8 |
| D | 27 | 22 kHz | 1.8 |

Figure 5:
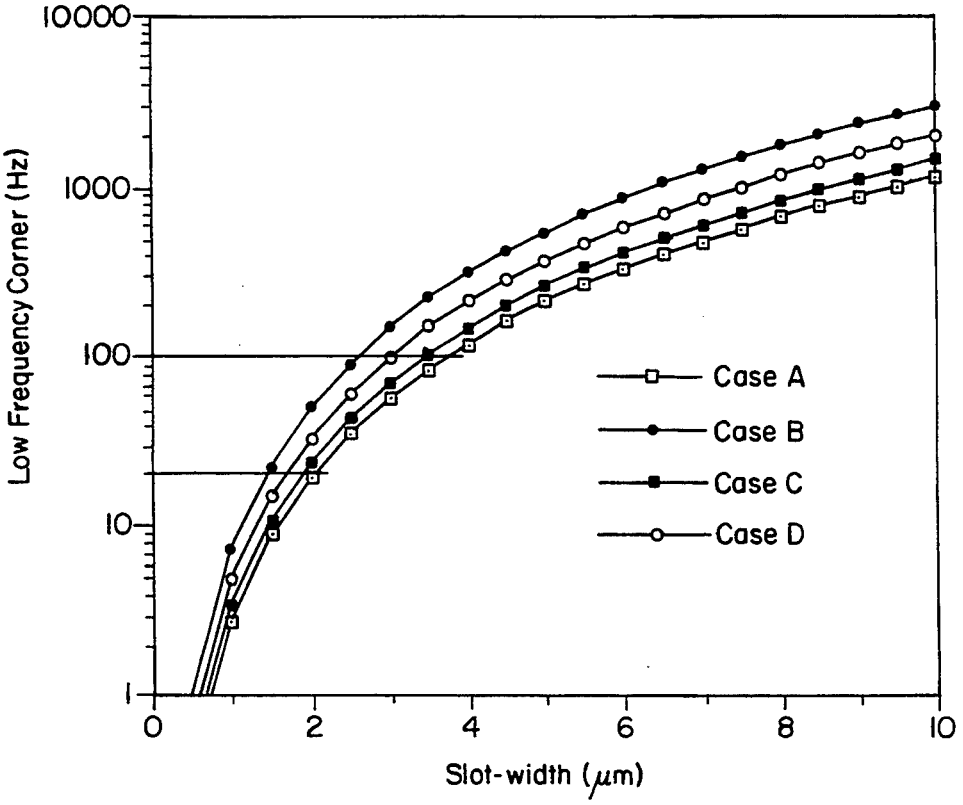
FIG. 5 depicts a family of curves illustrating the variation in low-frequency corner frequency with slot width for four different cavity volume, resonant frequency, and diaphragm diameter conditions.

The results are graphically illustrated in FIG. 5, where the low frequency corner frequency or 3 dB roll-off point is the ordinate dimension and the width of the pressure equalization slot is the abscissa dimension. There it can be seen that the low frequency roll-off point decreases dramatically with decrease in slot width. A slot width of 0.1 to 10 microns provides good low end frequency response. A range of slot width from approximately 0.5 microns to 5.0 microns is preferred.

Figure 6:
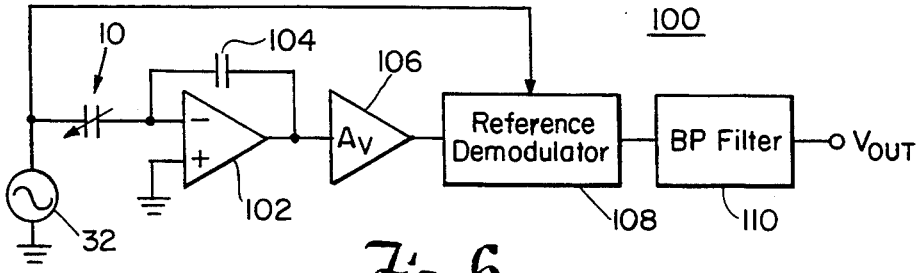
FIG. 6 is a schematic diagram of an a.c. detection circuit for use with the acoustic transducer according to this invention.

Transducer 10 may be employed in a detection circuit 100, FIG. 6, in which the a.c. signal generator 32 operates as a local oscillator at, for example, 100 kilocycles or more. Then variations in the capacitance in transducer 10 causes modulation of the 100 KHz carrier wave. Amplifier 102 with feedback impedance 104 amplifies the modulator carrier signal in the 100 KHz band. After further amplification in amplifier 106 the signal is synchronously demodulated in demodulator 108 using a reference signal derived from a.c. signal generator 32 to extract the modulating signal representing the capacitance fluctuation of transducer 10. The detected signal representative of the variation in capacitance and thus the strength of the incident acoustic wave energy may be further treated in bandpass filter 110 to remove any d.c., carrier and carrier harmonic components, and ultimately provide the output signal $V_{OUT}$.

Figure 7:
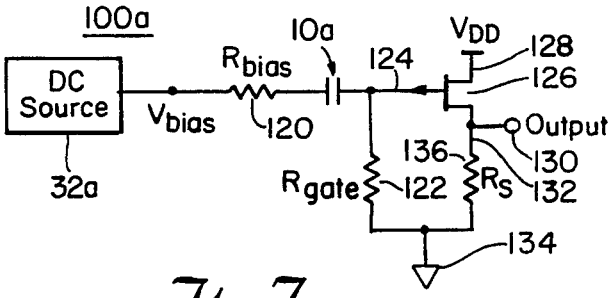
FIG. 7 is a schematic diagram of a d.c. detection circuit for use with the acoustic transducer according to this invention.

In a preferred d.c. detection circuit 100*a*, FIG. 7, d.c. source 32*a* provides a d.c. bias, $V_{bias}$, through bias resistor 120 to transducer 10*a*. Gate resistor 122 sets the voltage at the gate 124 of FET 126. A bias voltage, $V_{dd}$, which can be the same as $V_{bias}$ is applied to the drain electrode 128 and the output 130 is taken from the source electrode 132 which is connected to ground 134 through source resistor 136.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. An acoustic transducer comprising:

a perforated member;

a movable diaphragm spaced from said perforated member;

spring means interconnecting said diaphragm and said perforated member for movably supporting said diaphragm relative to said perforated member;

a pressure equalization slot for controlling the flow of fluid through said diaphragm; said slot equalizing the pressure on opposite sides of the diaphragm and having a width between 0.1 and 10$\mu$ for defining the low frequency response; and means for applying an electric field across said perforated member and said diaphragm for producing an output signal representative of the variation in capacitance induced by the variation of the space between said perforated member and said diaphragm in response to an incident acoustic signal.

2. The acoustic transducer of claim 1 in which a substantial portion of said slot is covered by said perforated member and said slot and perforations are unaligned to distort and lengthen the path of the fluid flow from said slot through said perforations.

3. The acoustic transducer of claim 1 in which said slot is disposed generally at the perimeter of said diaphragm.

4. The acoustic transducer of claim 3 in which said slot is approximately the length of the perimeter of said diaphragm.

5. The acoustic transducer of claim 1 in which said slot includes a plurality of sections.

6. The acoustic transducer of claim 1 in which said diaphragm is formed integrally with an insulator layer and said slot is formed at least partially between said conductive diaphragm and said insulator layer.

7. The acoustic transducer of claim 1 in which said slot is formed at least partially between portions of said conductive diaphragm.

8. The acoustic transducer of claim 1 in which said diaphragm, slot and spring means are made on a silicon wafer using micromachining photolithographic techniques.

9. The acoustic transducer of claim 1 in which said diaphragm and perforated member are made from a material from the group consisting of gold, nickel, iron, copper, silicon, polycrystalline silicon, silicon dioxide, silicon nitride, silicon carbide, titanium, chromium, platinum, palladium, aluminum and their alloys.

10. The acoustic transducer of claim 1 further including a filter spaced from said diaphragm for protecting said diaphragm from contaminants in the fluid.

11. An acoustic transducer comprising:

a perforated member;

a movable diaphragm spaced from said perforated member;

spring means interconnecting said diaphragm and said perforated member for movably supporting said diaphragm relative to said perforated member;

a pressure equalization slot for controlling the flow of fluid through said diaphragm; said slot equalizing the pressure on opposite sides of the diaphragm for defining the low frequency response; a substantial portion of said slot being covered by said perforated member and said slot and perforations being unaligned to deflect and lengthen the path of the fluid flow from said slot through said perforations; and means for applying an electric field across said perforated member and said diaphragm for producing an output signal representative of the variation in capacitance induced by the variation of the space between said perforated member and said diaphragm in response to an incident acoustic signal.

12. The acoustic transducer of claim 11 in which said slot has a width of between 0.1 and 10$\mu$.

13. The acoustic transducer of claim 11 in which said slot is disposed generally at the perimeter of said diaphragm.

14. The acoustic transducer of claim 13 in which said slot is approximately the length of the perimeter of said diaphragm.

15. The acoustic transducer of claim 11 in which said slot includes a plurality of sections.

16. The acoustic transducer of claim 11 in which said diaphragm is formed integrally with an insulator layer and said slot is formed at least partially between said conductive diaphragm and said insulator layer.

17. The acoustic transducer of claim 11 in which said slot is formed at least partially between portions of said conductive diaphragm.

18. The acoustic transducer of claim 11 in which said diaphragm, slot and spring means are made on a silicon wafer using micromachining photolithographic techniques.

19. The acoustic transducer of claim 11 in which said diaphragm and perforated member are made from a material from the group consisting of gold, nickel, iron, copper, silicon, polycrystalline silicon, silicon dioxide, silicon nitride, silicon carbide, titanium, chromium, platinum, palladium, aluminum and their alloys.

20. The acoustic transducer of claim 11 further including a filter spaced from said diaphragm for protecting said diaphragm from contaminants in the fluid.

* * * * *